US005581915A

United States Patent [19]

Lobato

[11] Patent Number: 5,581,915

[45] Date of Patent: Dec. 10, 1996

[54] SNOWPLOW CARRIAGE ASSEMBLY FOR MANUAL SNOW REMOVAL

[76] Inventor: Emmanuel J. Lobato, 177 Pembrook Dr., Yonkers, N.Y. 10710

[21] Appl. No.: 529,272

[22] Filed: Sep. 15, 1995

[51] Int. Cl.[6] ..... E01H 5/02

[52] U.S. Cl. ..... 37/285; 37/265; 294/58; 294/59; 280/47.34; 280/47.38

[58] Field of Search ..... 37/285, 273, 271, 37/241, 434, 265, 278, 403; 294/58, 59, 54.5; 280/47.38, 47.34, 30, 641, 651

[56] References Cited

U.S. PATENT DOCUMENTS

| | | | |
|---|---|---|---|
| 1,358,235 | 11/1920 | Nylin | 280/651 |
| 1,473,572 | 11/1923 | Fitzgerald | 294/59 X |
| 2,229,053 | 1/1941 | De Vaux | 37/273 |
| 2,441,449 | 5/1948 | Shaw | 37/285 X |
| 2,460,560 | 2/1949 | Williams | 37/271 X |
| 2,470,217 | 5/1949 | McLoughlin | 294/59 X |
| 2,552,016 | 5/1951 | Rose | 37/241 X |
| 2,930,152 | 3/1960 | Pipkin | 294/59 X |
| 2,997,796 | 8/1961 | Pogue et al. | 37/285 X |
| 3,343,807 | 9/1967 | Moraski | 294/59 X |
| 3,350,797 | 11/1967 | Dassinger et al. | 37/241 |
| 3,748,761 | 7/1973 | Chetwynde | 294/59 X |
| 4,130,953 | 12/1978 | Bruno | 37/265 |
| 4,214,385 | 7/1980 | Baranowski et al. | 294/59 X |
| 4,224,751 | 9/1980 | Shoemann et al. | 294/59 X |
| 4,570,961 | 2/1986 | Chateauneuf et al. | 280/47.26 X |
| 4,787,661 | 11/1988 | Rutledge | 294/58 |
| 4,804,219 | 2/1989 | Berg | 37/283 X |
| 4,910,893 | 3/1990 | Asay | 37/285 X |
| 5,048,206 | 9/1991 | Jones | 37/403 X |
| 5,054,278 | 10/1991 | Thorndike | 294/59 X |
| 5,271,169 | 12/1993 | Konsztowicz | 37/285 X |
| 5,511,327 | 4/1996 | Jurkowski et al. | 37/285 |

*Primary Examiner*—Randolph A. Reese
*Assistant Examiner*—Thomas A. Beach
*Attorney, Agent, or Firm*—Emmanuel Joseph Lobato; Lobato Law Offices

[57] ABSTRACT

A snowplow carriage assembly for removal of snow manually by plowing the snow in an area to be cleared of snow. The carriage is a manually propelled wheeled structure made of a plurality of members pivotally connected for collapsing and folding for storage and unfolding for use in supporting and transporting a snowplow in the form of a replaceable conventional snow shovel having a handle straight length portion. The carriage is configured so that the snow shovel handle is removably mounted thereon inclined from the horizontal defining an acute angle relative to a surface on which snow is being plowed. The snow shovel inclination is variable for establishing different acute angles of the shovel relative to the surface for plowing the snow thereon and removal therefrom.

11 Claims, 3 Drawing Sheets

FIG. 7
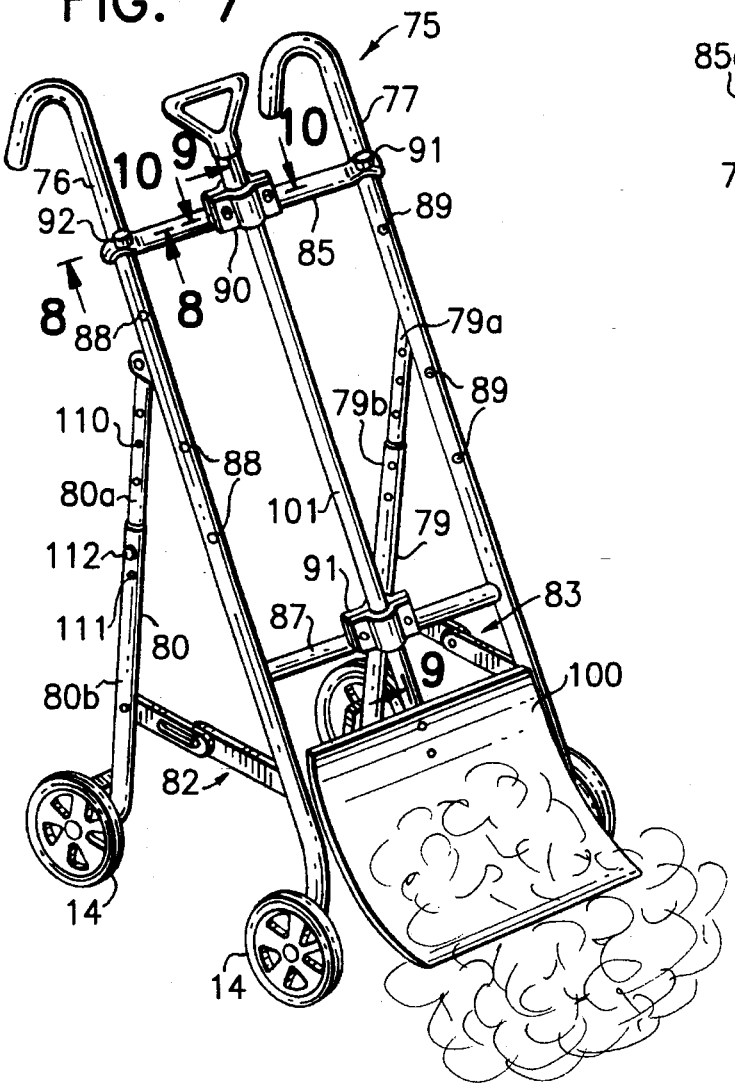
FIG. 8
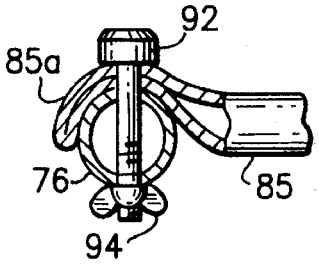
FIG. 9
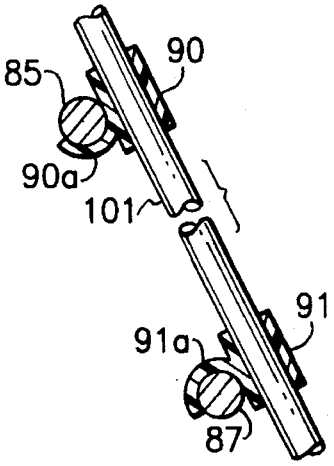
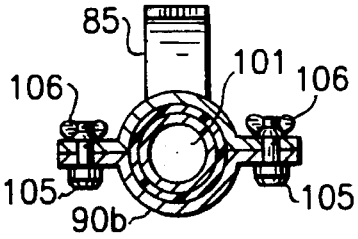
FIG. 10

SNOWPLOW CARRIAGE ASSEMBLY FOR MANUAL SNOW REMOVAL

BACKGROUND OF THE INVENTION

1. Field of the Invention

This invention relates generally to snow removal and more particularly to a snowplow carriage assembly for removing snow by plowing it manually.

2. Prior Art

Heretofore the removal of snow manually at residences by homeowners has been accomplished by use of conventional snow shovels and the use of brooms. The shoveling of snow by homeowners subjects the heart of the shoveler to considerable stress, and even young people have been known to have a heart attack after shoveling snow. Doctors now warn people that if they are fifty years of age, they should not shovel snow.

While a conventional snow shovel can be used to plow the snow in an area for removal without pitching the snow or shoveling it, which is stressful, a conventional snow shovel used for simply plowing the snow still requires a considerable amount of energy input by the user. There is a need for a device for clearing areas of snow by manual plowing of the snow for removal without subjecting the snow remover to excessive harmful stresses.

SUMMARY OF THE INVENTION

The snowplow carriage assembly, according to the invention, is a collapsible or foldable carriage on which is transportably mounted a snowplow. The snowplow is a conventional snow shovel removably and replaceably mounted on the carriage on which it is transported and pushed forwardly for plowing and removing snow from an area to be cleared.

The snowplow carriage assembly is constructed as a structure which can be collapsed and folded into a compact assembly with the snowplow thereon, or off of it, for storage, and can be readily prepared to use by opening the assembly into an expanded or unfolded state for plowing snow. Provision is made for adjustably positioning the snowplow at different acute angles relative to the surface on which the snow is being plowed. The carriage can accommodate different types of snow shovels having different length handles.

BRIEF DESCRIPTION OF THE DRAWINGS

The snowplow carriage assembly, according to the invention, description can be readily understood with reference to the appended claims and drawings in which:

FIG. 7 is a perspective elevation view of a second embodiment of a snowplow carriage assembly, according to the invention;

FIG. 8 is a section view taken along section line 8—8 of FIG. 7;

FIG. 9 is a section view taken along section line 9—9 of FIG. 7; and FIG. 10 is a section view taken along section line 10—10 of FIG. 7.

DESCRIPTION OF THE PREFERRED EMBODIMENTS

Figure 1:
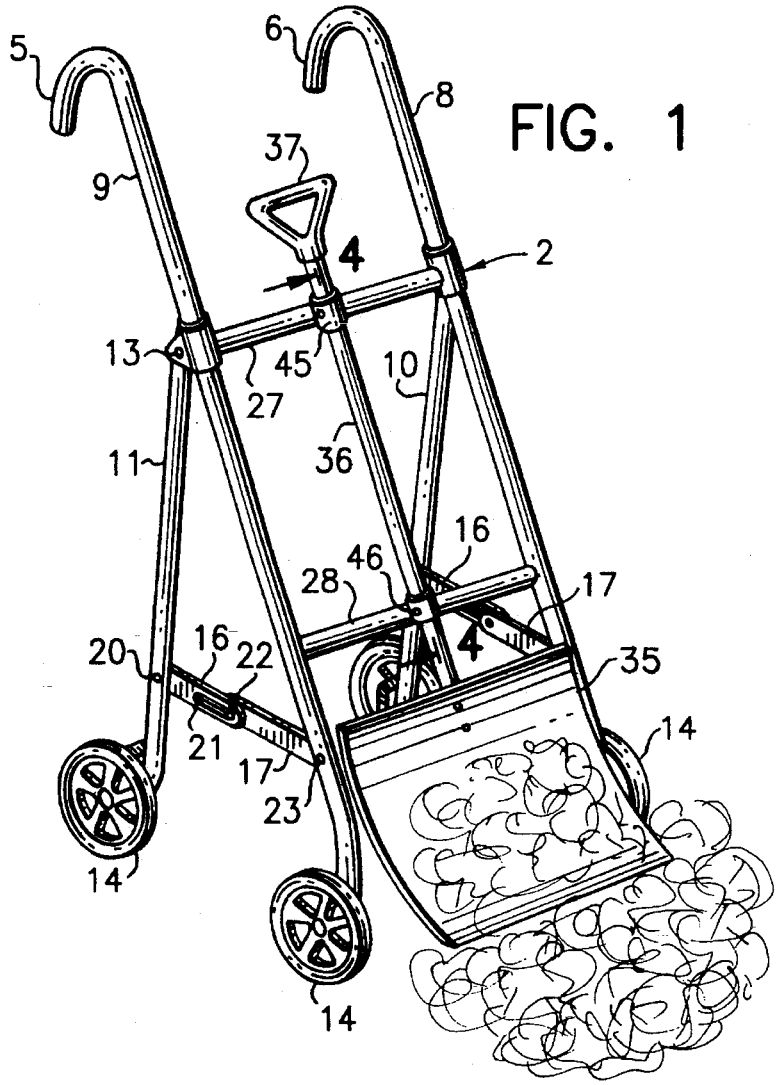
FIG. 1 is a perspective view of a snowplow carriage assembly, according to the invention.

A snowplow carriage assembly 2, according to the invention, is illustrated in FIG. 1, on which is mounted a snowplow illustrated as a conventional snow shovel. The carriage assembly consists of a single frame which has handles 5, 6 having elongated arms 8, 9 extending therefrom and which can be made tubular, for example. The elongated arms 8, 9 have tubular legs 10, 11 each connected pivotally and the snow shovel is used to function as a blade of the snowplow to the respective arms by a pivot such as a pivot 13. The carriage arms and legs are each provided with wheels 14. The wheels on the arms can be provided with swivels.

Figure 2:
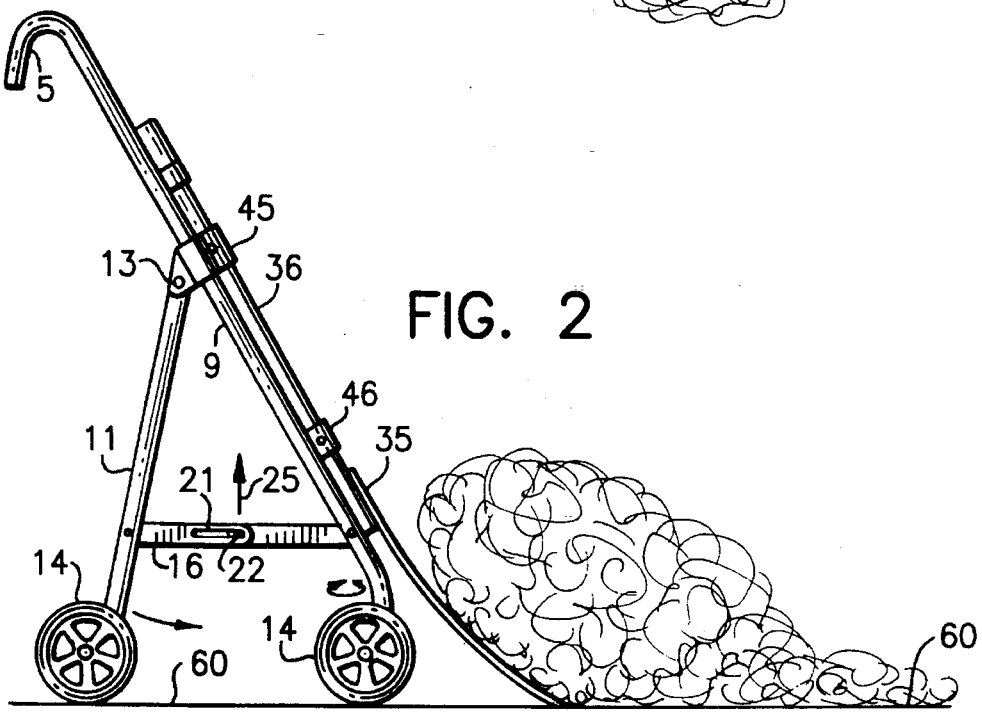
FIG. 2 is a side elevation view of the snowplow carriage assembly in FIG. 1.
Figure 3:
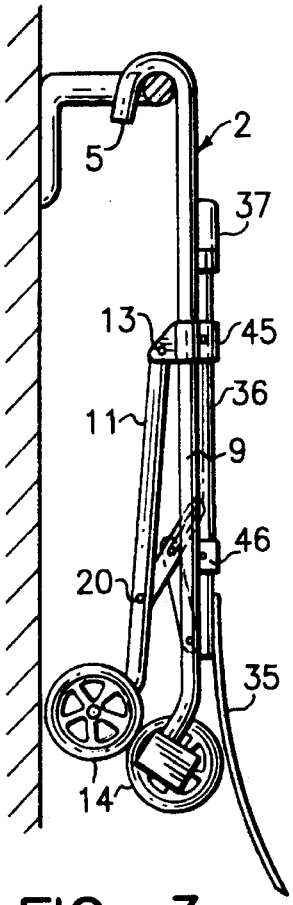
FIG. 3 is a side elevation view of the snowplow carriage assembly in FIG. 1, illustrated in a folded state for storage.
Figure 4:
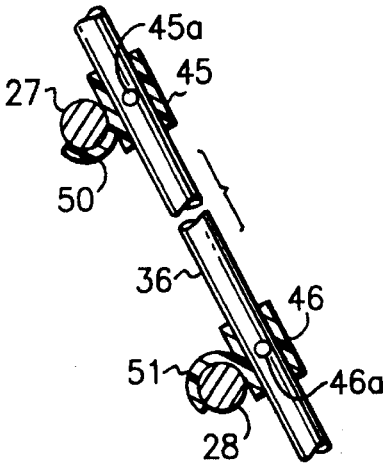
FIG. 4 is a section view taken along section line 4—4 in FIG. 1.

Provision is made for the legs 10, 11 to extend away from the arms 8, 9 in an unfolded state of the carriage as shown in FIG. 1 and to be foldable as shown in FIG. 3. A pair of linkage systems in the known form of relatively slidable links 16, 17 are respectively pivotally connected to a corresponding arm and leg. When the links are in an extended condition the individual legs are moved, and held, outwardly spaced away from the corresponding arms. The linkage system link 16 has an end pivotally connected at a pivot 20 to the corresponding leg 11 and has a longitudinal slit 21 in which a pivot pin 22 fixed on the other link 17 slides. The other link 17 is pivotally connected by a pivot 23 to the arm 9. When the carriage is in an unfolded state or condition the links extend from each other as shown in FIGS. 1 and 2. The pin 22 is received in a notch in the end of the slit 21 and locks the corresponding linkage system in an extended condition, and the carriage is held in an opened condition for plowing snow. The links are operable upwardly, as illustrated by an arrow 25 in FIG. 2 to release the pivot pin 22 from the notch so it can slide in the slit 21 to collapse the linkage system in a position shown in FIG. 3 for folding the carriage assembly for storage when not in use.

The two carriage arms 8, 9 are held parallel laterally spaced by two carriage transverse members or cross bars 27, 28 fixed, at ends thereof, axially spaced on the arms. The two cross bars can be made tubular and connected to the arms in any suitable manner such as shown in FIG. 1. The cross bars are arranged so that the upper bar 27 is higher than the lower bar 28 and both are in an inclined plane defined by the arms and the cross bars. This plane makes an acute angle with the horizontal and is the plane in which a snowplow is mounted, as described below, at a suitable acute angle relative to the horizontal, for plowing snow for manual removal thereof.

A snowplow 35 in the form of a conventional snow shovel having a handle 36 and a handle grip 37 is removably and replaceably mounted on the carriage 2 for plowing snow as the carriage is advanced manually. The snowplow or snow shovel is mounted at an angular position relative to the horizontal, as shown in FIG. 2. The carriage 2 is constructed so that in an unfolded condition the snowplow is held in a plane at an angular position relative to the horizontal similar to an acute angle at which snow shovels are used manually to plow snow to clear an area from which snow is being removed by simply plowing.

In order to mount the snowplow on the carriage, the snow shovel is provided with a pair of spaced holders 45, 46 which are fitted axially on the handle 36 of the snow shovel. The holders are constructed so that the upper holder 45 has an upwardly directed hook 50 and the lower holder 46 has a downwardly directed hook 51. These hooks engage the upper cross bar 27 and the lower cross bar respectively on the carriage. The lower hook 51 positions the snow shovel 35 at a position so that the snow will be plowed, for example, along a surface 60. The upper hook maintains the shovel from moving upwardly when snow plowing is taking place. It can be seen that with the holder arrangement illustrated, the shovel handle 36 is subjected to the same type of forces to which it would be subjected if the shovel were being used manually as a plow without being supported and carried on a carriage. The holders are positionable axially spaced on the handle and held in position by bolts 45*a*, 46*a* which extend through the handle and have wing nuts on an end thereof so that the bolts can be removed and the snow shovel replaceably removed from the carriage 2.

Snow removal is generally accomplished manually by moving a snow shovel forwardly to plow and move the snow as desired. In order to reduce the workload, snow removal is accomplished by removing snow by plowing a pathway as wide as the shovel 35. People can then walk readily along such a path single file or the path can be widened by making two passes with the snow shovel. The present invention provides for reducing the plowing load in advancing the snow shovel mounted on the carriage by providing for moving the snow laterally as the carriage is advanced for plowing snow.

Figure 5:
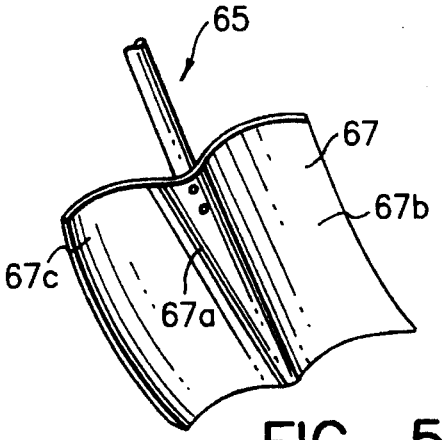
FIG. 5 is a fragmentary perspective view of a second embodiment of a snowplow, according to the invention.

A snowplow configuration which has a V-shaped front surface is illustrated in FIG. 5. A snow shovel 65 illustrated has a shovel 67 in which a front center section 67*a* projects forwardly of two trailing opposite side sections 67*b*, 67*c* that extend rearwardly of the central section so that as the center section advances, snow being plowed is diverted laterally in two directions by the side sections which trail the center section. The outer side edges of the side sections trail the leading surface of the center section sufficiently so that in effect the shovel is V-shaped. In the V-shaped shovel 67 the side sections 67*b*, 67*c* are disposed dimensionally and angularly symmetrically relative to the center section 67*a*.

Those skilled in the art will understand that the shovel configuration can be that of an asymmetrical V-configuration as well as symmetrical. Moreover, the angle at which the side sections trail rearwardly can be different in the shovel configurations even if the shovel is symmetrical dimensionally. The shovel side sections can be made dimensionally asymmetrical. One side section can extend laterally and rearwardly a greater distance from the center section than the other side section and the respective angle at which the individual sections diverge rearwardly from the center section can be the same or can be different whether the sections are both the same dimensionally or each different dimensionally. Thus, different possibilities of symmetry and asymmetry are possible, resulting by use of same or different angles which the side sections make with the center section and the same or different dimensions of the side sections. In all such cases, the shovel has a V-configuration which has a more open or more closed angle and the sides of such a "V" of different side lengths. Providing the V-configuration makes it possible to provide snowplows for different plowing problems. For example, differences in walks or paths to be plowed can be handled better either by a symmetrical or a non-symmetrical plow depending on the path to be plowed. It is, of course, understood that such V-shaped snowplows would be snow shovels which would generally not be used for shoveling snow and are only for plowing.

Figure 6:
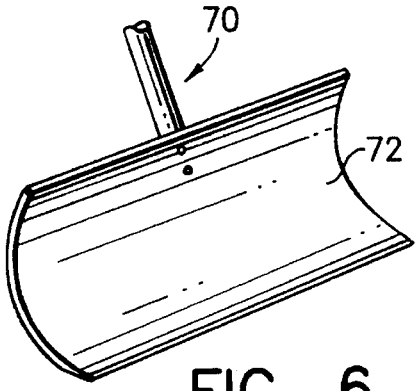
FIG. 6 is a fragmentary perspective view of a third embodiment of a snowplow, according to the invention.

The carriage 2 can be used for plowing snow from areas larger than pathways or walks such as driveways. A wider snowplow 70 is illustrated in FIG. 6 as having a shovel 72 which has a conventional handle 73 and is wider than those heretofore described. The wider snow shovel 72 makes it possible to plow an area such as a driveway. The wider snow shovel is illustrated as somewhat arcuate in its height cross section to provide somewhat of a snow scooping action of the snowplow since the shovel is not used on the carriage for shoveling but plowing. The curvature provides the necessary lift to the snow to effectively plow the snow.

Snow shovels generally have handles which have a length on the handle which is straight even if the entire handle is not straight along its full length. Moreover, snow shovels have handles of different lengths. The shovels themselves have different cross section configurations along the shovel height dimension. Generally, snow shovels have a marginal lower edge portion of the height dimension that is arcuate and has curvature along part of the marginal leading edge portion of the shovel so that snow can be scooped up.

The snowplow carriage assembly, according to the invention, makes provision for differences in length of handles of the different snow shovels and for different curvatures along the height of the different snow shovels. Furthermore, provision is made for mounting the snow shovels without need of holders being provided on the shovels for mounting them on a carriage for transport for plowing according to the invention.

A second embodiment of a carriage is illustrated in FIG. 7 in which a carriage 75 is constructed generally similar to the carriage 2 of FIG. 1. This second embodiment carriage is wheeled and has two arms 76, 77 and legs 79, 80 pivotally connected to the respective arms and has linkage systems 82, 83 so that it can be folded or collapsed and unfolded as the first carriage embodiment described. In order to be able to mount snow shovels of different handle lengths, the carriage is provided with an upper cross bar 85 which is movable to different positions axially of the arms for spacing variably with respect to a lower cross bar 87 which is fixed to the two arms. The arms are provided with a plurality of axially spaced holes 88, 89 along the length of the arms for mounting the upper arm 85 at different axial positions axially of the arms in order to accommodate snow shovels of different lengths of handles for mounting and transport on the carriage 75.

The upper cross bar 85 has at each opposite end thereof a curved hook 85*a* that rests on the corresponding arm 76, 77 as illustrated in FIGS. 7 & 8. Each hook 85*a* has a hole of equal dimension as the holes 88, 89 on the arms, and the upper cross bar 85 is mounted with the hook holes in registry with the holes on the arms so that bolts 91, 92, having wing nuts 94, can be inserted through the hook and corresponding arms and the upper arm secured to the carriage. The provision of an upper arm construction as shown in FIG. 8 and the mounting holes 88, 89 on the carriage 75 arms 76, 77 provides for variably adjusting the mounting of different types of snow shovels having different length handles, for example.

The second embodiment carriage assembly provides for easily mounting the different snow shovels by use of two split clamps or holders 90, 91 having hooks 90*a*, 91*a* engaging the cross bars 85, 87 as shown in FIG. 9 to maintain a snow shovel 100 and its handle 101 in position when plowing snow as described with respect to the first embodiment carriage assembly. The split holders each can also have a compressible liner as shown at 90*b*, so they can be clamped on different diameter snow shovel handles. They are held assembled by the bolts 105 with a wing nut 106. Snow shovels can easily be replaced on the carriage.

The second embodiment carriage can be adjusted as to the acute angle that the plane cross bars on the arms 76, 77 make relative to the horizontal. The legs 79, 80 are made so that the legs are made with upper lengths or sections 79*a*, 80*a* which telescope into lower sections 79*b*, 80*b*. The length of the legs is variably adjusted by providing axially spaced holes 110, 111 on the leg sections so that the length of the legs can be varied telescopically and the adjusted length maintained by bolts 112 which extend through the holes in the upper and lower leg sections which are aligned to set the variable length of the legs to vary the acute angle at which a snow shovel will make with the surface on which the snow is being plowed. Thus, the angle of the plow can be varied. Moreover, this adjustability of leg length makes it comfortable for users of different heights to use the snowplow carriage assembly best suited to their height and the angle at which they wish to use as a setting for the snowplow.

While the members of the carriages are described as tubular, they can be made as solid members of any suitable metallic or plastic materials. Components can be made of strong wood with or without reinforcements. The carriage components can be provided as a kit made for easy assembly. Suitable connections are provided for the various components.

It should be noted that the carriage is constructed so that at times the plowing of snow can be carried out with the legs in a retracted or folded position, if desired. This provides a wide range of possible acute angles at which the snowplow will plow the snow when desired. However, the carriage is intended to provide walking support for the users, old or young, and to be used principally as described in an unfolded state supported on all its wheels.

What I claim is:

1. A snowplow carriage assembly for removably mounting thereon and using as a snowplow, a snow shovel having a handle and generally used separately from said carriage for shoveling snow manually, said snowplow carriage assembly comprising:

a wheeled manually pushed carriage consisting of a single frame having two members defining two elongated arms laterally spaced extending at an acute angle relative to the horizontal and lower ends thereof, disposed in a forward direction of travel of the carriage on a surface for removal of snow therefrom by plowing, two transverse members on said frame mounted between said elongated arms transversely thereof, connected thereto, and spaced axially thereon for removably mounting on said frame a handle of a snow shovel having a handle stationarily fixed thereto and generally used for shoveling snow when not mounted on said carriage, said transverse members being positioned on said frame for removably mounting thereon, the snow shovel handle disposed extending between the arms and transversely of and overlying the transverse members and the shovel disposed to function as a snowplow blade disposed defining an acute angle relative to the horizontal and forwardly of the lower ends of the elongated arms in position for plowing snow on said surface for removal therefrom, by plowing as the carriage is manually advanced on said surface;

a pair of leg members for supporting and transporting said carriage frame each pivotally connected to a respective elongated arm of said carriage frame intermediate opposite ends of the elongated arms for positioning thereof, extending downwardly therefrom, each defining an acute angle relative to a respective arm and an acute angle relative to the horizontal and disposed in a direction rearwardly of the forward direction of travel of the carriage and selectively manually pivotable toward the respective arms alternately with and without the snow shovel being mounted on said carriage for folding the carriage to assume a collapsed state; and wheels, at least one each mounted on free ends of said leg members and on the lower ends of the elongated arms.

2. A snowplow carriage assembly according to claim 1, in which said leg members are variably extendable to selectively vary the acute angle the elongated arms of the carriage define relative to the horizontal to thereby vary the angle the handle of the snow shovel makes relative to the horizontal and thereby also the shovel functioning as a the snowplow blade.

3. A snowplow carriage assembly according to claim 1, in which said elongated arms have handle means for manually pushing the carriage, and in which said leg members are variably extendable for selectively varying the height of said handle means relative to the surface on which the carriage travels while maintaining the snow plow blade in position for plowing thereby permitting compensation for the height of a user of the carriage alternatively with a snow shovel mounted thereon and without the snow shovel being mounted on the carriage.

4. A snowplow carriage assembly according to claim 1, in which one of said frame transverse members is variably positionable in different fixed axial positions on the elongated arms to vary axial spacing of the transverse members and permit removably mounting different length snow shovel handles on said frame for using alternatively different types of snow shovels individually as a snowplow on a same carriage.

5. A snowplow carriage assembly according to claim 1, including mount means for removably mounting the snow shovel handle fixed on at least one transverse member of said frame.

6. A snowplow carriage assembly according to claim 5, in which said mount means comprises clamps for alternatively mounting on said frame snow shovels having individually handles of separate cross section dimensions.

7. A snowplow carriage assembly according to claim 1, including means for pivotally connecting said leg members to said arms for permitting the leg members to be manually pivotable individually.

8. A snowplow carriage assembly according to claim 1, including two collapsible linkage systems each pivotally connected individually to a respective elongated arm and a corresponding leg member thereof, each linkage system comprising a pair of links pivotal and slidable relatively to permit the individual leg member to be manually pivoted individually toward a respective arm for folding the carriage and slidable relatively to extended positions releasably locked extending from each other effective to maintain individually the leg members spaced from the respective arms to provide four wheel stability to the carriage with the leg members depending from the respective arms.

9. A snowplow carriage assembly for removably mounting thereon and using as a snowplow, a snow shovel having a handle and generally used for shoveling snow manually, and said snowplow carriage assembly comprising in combination:

a wheeled manually pushed carriage consisting of a single frame having two elongated arms laterally spaced extending at an acute angle relative to the horizontal and lower ends thereof disposed in a forward direction of travel of the carriage on a surface for removal of snow therefrom by plowing, two transverse members on said frame mounted on said elongated arms transversely thereof, and spaced axially thereon for removably mounting on said frame a snow shovel having a handle stationarily fixed thereon and generally used for shoveling snow when not mounted on said carriage, a snow shovel having said handle removably mounted on said transverse members;

said transverse members being positioned on said frame removably mounting thereon the snow shovel handle immobile and disposed extending between the arms and transversely of and overlying the transverse members and the shovel disposed to function as a snowplow blade disposed defining an acute angle to the horizontal and forwardly of the lower ends of the elongated arms in position for plowing snow on said surface for removal therefrom, as the carriage with said snow shovel thereon is manually advanced on said surface;

a pair of leg members for transporting of said carriage frame each pivotally connected to a respective elongated arm of said frame intermediate opposite ends of the elongated arms for positioning thereof, extending downwardly therefrom, each defining an acute angle relative to a respective arm and an acute angle relative to the horizontal and disposed in a direction rearwardly of the forward direction of travel of the carriage and selectively manually pivotable toward the respective arms alternatively with and without the snow shovel being mounted on said carriage for folding the carriage to assume a collapsed state; and wheels, at least one each mounted on free ends of said leg members and on the lower ends of the elongated arms.

10. A snowplow carriage assembly according to claim 9, in which said snow shovel defines a snowplow V-shaped in cross section along a width thereof.

11. A kit for constructing a snowplow carriage assembly for removably mounting thereon, and using as a snowplow, a snow shovel having a handle and generally used for shoveling snow manually, and said snowplow carriage assembly comprising:

a plurality of connectable members for assemblying a wheeled manually pushed carriage consisting of a single frame having two elongated arms laterally spaced extending at an acute angle relative to the horizontal and lower ends thereof, disposed in a forward direction of travel of the carriage on a surface for removal of snow therefrom, by plowing, said connectable members including two members mountable as two transverse members on said frame mounted on said elongated arms transversely thereof, and spaced axially thereon for removably mounting fixed on the assembled frame a snow shovel having a handle stationarily fixed thereon, and generally used for shoveling snow when not mounted on said carriage, said transverse members being connectable to said transverse members positionable on said assembled frame for removably mounting thereon the snow shovel handle disposed extending between the arms and transversely of the transverse members and the shovel disposed to function as a snow plow blade disposed defining an acute angle to the horizontal and forwardly of the lower ends of the elongated arms in position for plowing snow on said surface for removal therefrom as the carriage with said snow shovel thereon, is manually advanced on said surface;

a pair of leg members mountable on said frame each pivotally connectable to a respective one of said two members constituting an elongated arm of said frame intermediate opposite ends of the elongated arms for positioning thereof, extending downwardly therefrom each defining an acute angle relative to a respective arm and an acute angle relative to the horizontal and disposed in a direction rearwardly of the forward direction of travel of the carriage and selectively manually pivotable toward the respective arms for folding the carriage to assume a collapsed state; and four wheels, one each mountable on free ends of said leg members and on the lower ends of the elongated arms.

* * * * *